US007187350B2

(12) United States Patent
Yoshida

(10) Patent No.: US 7,187,350 B2
(45) Date of Patent: Mar. 6, 2007

(54) ACTIVE TYPE LIGHT EMITTING DISPLAY DEVICE

(75) Inventor: Takayoshi Yoshida, Yonezawa (JP)

(73) Assignee: Tohoku Pioneer Corporation, Yamagata (JP)

( * ) Notice: Subject to any disclaimer, the term of this patent is extended or adjusted under 35 U.S.C. 154(b) by 558 days.

(21) Appl. No.: 10/684,442

(22) Filed: Oct. 15, 2003

(65) Prior Publication Data

US 2004/0080475 A1 Apr. 29, 2004

(30) Foreign Application Priority Data

Oct. 17, 2002 (JP) ..... 2002-302740

(51) Int. Cl.
*G09G 3/30* (2006.01)
*G09G 3/10* (2006.01)

(52) U.S. Cl. ..... 345/76; 345/82; 345/205; 345/690; 315/169.1; 315/169.3

(58) Field of Classification Search ..... 345/76–78, 345/80, 82, 205, 214, 690; 315/169.1, 169.3
See application file for complete search history.

(56) References Cited

U.S. PATENT DOCUMENTS 6,774,877 B2 * 8/2004 Nishitoba et al. ..... 345/76
6,778,151 B2 * 8/2004 Li ..... 345/55
6,781,320 B2 * 8/2004 Park et al. ..... 315/169.1
6,841,948 B2 * 1/2005 Yoshida ..... 315/169.3

FOREIGN PATENT DOCUMENTS

JP 9-232074 9/1997

OTHER PUBLICATIONS

Jung, Sang-Hoon, et al. P-104: A New Voltage Modulated AMOLED Pixel Design Compensating Threshold Voltage Variation of Poly-Si TFTs, SID 02 Digest, ISSN/0002, pp. 622-625.

* cited by examiner

*Primary Examiner*—Henry N. Tran
(74) *Attorney, Agent, or Firm*—Westerman, Hattori, Daniels & Adrian, LLP.

(57) ABSTRACT

One pixel (10) is comprised of a controlling TFT (Tr1), a TFT (Tr3) functioning as a threshold voltage generating element, a TFT (Tr4) functioning as a reset element, a driving TFT (Tr2), a capacitor (C1) holding the gate voltage of the driving TFT, a TFT (Tr5) functioning as a current restraining means for being controlled so as to be OFF at a reset operation time, and an EL element (E1). At the reset operation time in which a terminal voltage of the capacitor (C1) is reset to a predetermined electrical potential, a current restraining means comprising the TFT (Tr5) is controlled so as to prevent excess current due to an operation of the driving TFT (Tr2) from being imparted to the EL element (E1).

16 Claims, 6 Drawing Sheets

ACTIVE TYPE LIGHT EMITTING DISPLAY DEVICE

BACKGROUND OF THE INVENTION

1. Field of the Invention

The present invention relates to a light emitting display device in which a light emitting element constituting a pixel is actively driven by a TFT (Thin Film Transistor) and particularly to an active type light emitting display device in which a problem occurring in the case where a so-called threshold voltage compensation technique is utilized as a lighting driving means for a light emitting element can be solved.

2. Description of the Related Art

A display using a display panel in which light emitting elements are arranged in a matrix pattern has been developed widely. As a light emitting element employed in such display panel, an organic EL (electro-luminescent) element in which an organic material is employed in a light emitting layer has attracted attention. This is because of backgrounds one of which is that by employing, in a light emitting layer of an EL element, an organic compound which enables an excellent light emitting characteristic to be expected, a high efficiency and a long life have been achieved which make an EL element satisfactorily practicable.

As display panels in which such organic EL elements are employed, a simple matrix type display panel in which EL elements are simply arranged in a matrix pattern and an active matrix type display panel in which an active element consisting of a TFT is added to each of EL elements arranged in a matrix pattern have been proposed. The latter active matrix type display panel can realize low power consumption, compared to the former simple matrix type display panel, and has characteristics such as less cross talk between pixels and the like, thereby being specifically suitable for a high definition display constituting a large screen.

FIG. 1 shows a most basic circuit configuration corresponding to one pixel 10 in a conventional active matrix type display device, which is called a conductance control technique. In FIG. 1, a gate of a controlling TFT (Tr1) comprised of P-channels is connected to a scan line extending from a scan driver 1, and its source is connected to a data line extending from a data driver 2. A drain of the controlling TFT (Tr1) is connected to a gate of a driving TFT (Tr2) comprised similarly of P-channels and to one terminal of a capacitor C1 provided for holding electrical charges.

A source of the driving TFT (Tr2) is connected to the other terminal of the capacitor C1 and to an anode side power source (VHanod) supplying a driving current to an EL element E1 provided as a light emitting element. A drain of the driving TFT (Tr2) is connected to an anode of the EL element FL1, and a cathode of this EL element is connected to a cathode side power source (VLcath).

When an ON controlling voltage (Select) is supplied to the gate of the controlling TFT (Tr1) shown in FIG. 1 via the scanline, the controlling TFT (Tr1) allows current which matches a data voltage (Vdata) supplied from the data line to the source to flow from the source to the drain. Therefore, during the period when the gate of the controlling TFT (Tr1) is ON voltage, the capacitor C1 is charged, and the capacitor's voltage is supplied to the gate of the driving TFT (Tr2). Thus, the driving TFT (Tr2) allows current which is based on the gate voltage and the source voltage of the TFT (Tr2) to flow in the EL element E1 to drive the EL element so that the EL element emits light.

When the gate of the controlling TFT (Tr1) becomes an OFF voltage, the controlling TFT (Tr1) becomes a so-called cutoff, and the drain of the controlling TFT (Tr1) becomes an open state. The gate voltage of the driving TFT (Tr2) is maintained by electrical charges accumulated in the capacitor C1, the driving current is maintained until a next scan, and the light emission of the EL element 14 is also maintained.

Meanwhile, in order to actively drive a current drive type light emitting element represented by an organic EL element, it is remarked that a material constituting a TFT has to have a considerably high electron mobility, and in general a low temperature polysilicon is employed in order to drive the light emitting element. However, in this type of polysilicon TFT, it is know that threshold voltage variations occur due to formation of a crystal body, and these threshold voltage variations of TFTs causes variations in drain currents of driving TFTs. It is known that the above-mentioned organic EL element emits light whose intensity is approximately proportional to the driving current, and thus the drain current variations of driving TFTs directly cause light emission intensity variations among pixels.

Thus, in order to compensate unevenness in intensity among pixels based on variations in threshold voltages of TFTs, a pixel structure provided with four TFTs as shown in FIG. 2 has been proposed. The structure shown in FIG. 2 is called a threshold voltage compensation technique herein, and by this structure, operation is performed so as to effectively compensate the threshold characteristic of a driving TFT as described later. This threshold voltage compensation technique is introduced in Reference 1 shown below which is not a patent document:

Sang-Hoon Jung, Woo-Jin Nam and Min-Koo Han, "A New Voltage Modulated AMOLED Pixel Design Compensating Threshold Variation of Poly-Si TFTs," SDI International Symp. Proc., pp. 622–624, 2002.

In the structure of FIG. 2, a gate of a controlling TFT (Tr1) comprised of P-channels is connected to a scan line extending from a scan driver 1, and its source is connected to a data line extending from a data driver 2. A drain of the controlling TFT (Tr1) is similarly connected to a gate of a driving TFT (Tr2) of P-channel type via a parallel connection part of P-channel type TFT (Tr3), TFT (Tr4) formed in the same pixel 10.

A capacitor C1 which maintains the gate voltage of the driving TFT (Tr2) in a lighting driving state of an EL element E1 is connected between the gate and the source of the driving TFT (Tr2), and said source is connected to an anode side power source (VHanod) which supplies a driving current to the EL element E1. The drain of the driving TFT (Tr2) is connected to an anode of the EL element E1, and a cathode of this EL element is connected to a cathode side power source (VLcath).

The parallel connection part of the TFT (Tr3) and the TFT (Tr4) connected between the drain of the controlling TFT (Tr1) and the gate of the driving TFT (Tr2) is constructed in such a way that respective gates and drains are in a short circuit state and that the sources and the gates of the TFT (Tr3) and the TFT (Tr4) are connected in reverse parallel.

In the above-described structure, the roles of the controlling TFT (Tr1), the driving TFT (Tr2), and the electrical charge holding capacitor C1 are approximately similar to those in the example shown in FIG. 1. In the structure in which the sources and the gates of the TFT (Tr3) and the TFT (Tr4) are connected in reverse parallel, when the electrical potential (Va=Vdata) of a point in FIG. 2 is a predetermined value higher than the electrical potential (Vb)

of b point, the TFT (Tr3) is brought to an ON state, and the TFT (Tr4) is brought to an OFF state. Conversely, when the electrical potential (Va) of a point is a predetermined value lower than the electrical potential (Vb) of b point, the TFT (Tr3) is brought to an OFF state, and the TFT (Tr4) is brought to an ON state. Utilizing these functions, in the pixel structure shown in FIG. 2, for example, performed are a reset operation in which the electrical charges of the capacitor C1 are reset for every frame and a write operation in which data is newly written in the capacitor C1.

FIG. 3 is timing charts for explaining such operations, and first, at a timing shown as 1, a Select voltage supplied from the scan driver 1 is switched to a low level. By this, the controlling TFT (Tr1) is brought to the ON state. At this time data voltage Vdata supplied from the data driver 2 is at a low level, thus the TFT (Tr4) is bought to the ON state, and a terminal voltage of the capacitor C1, that is, the electrical potential of b point (Vb), is reset to a state of a fully low in the vicinity of the above-described low level Vdata.

Then, at a timing shown as 2, the data voltage Vdata supplied from the data driver 2 is raised. At this time the TFT (Tr3) becomes the ON state, and the TFT (Tr4) is brought to the OFF state. Accordingly, a data voltage whose level is dropped a threshold voltage caused by the TFT (Tr3) from the data voltage Vdata supplied from the data driver 2 (that is, a data voltage which is level shifted to a lower voltage side) is written in the capacitor C1 as the gate voltage.

Thereafter, at a timing shown as 3, since the Select voltage supplied from the scan driver 1 is switched to a high level, the controlling TFT (Tr1) is brought to a cutoff state, and at a timing shown as 4, the data voltage Vdata is switched to the low level. That is, it can be stated that the period from said 1 to said 2 is a reset period and that the period from said 2 to said 3 is a data writing period with respect to the capacitor C1. Based on the driving TFT (Tr2) gate voltage which has been written in the capacitor C1 in the writing period, the driving TFT (Tr2) supplies the driving current (drain current) to the EL element E1 over a period of one frame.

Therefore, a part between the source and the gate of the TFT (Tr3) functions as a threshold voltage generating element by which a level shift is performed using the threshold voltage, and a part between the source and the gate of the TFT (Tr4) functions as a reset element by which the terminal voltage of the capacitor C1 is reset and becomes a predetermined voltage through the ON operation of the TFT (Tr4).

Meanwhile, variations in the threshold voltages of the respective TFT (Tr2) and TFT (Tr3) formed in the same pixel as shown in FIG. 2 is considerably small, and it can be stated that both threshold voltages are almost the same. Accordingly, in the writing period, the gate voltage written in the capacitor C1 is allowed to be a value obtained by canceling the threshold voltage of the driving TFT (Tr2) substantially. Thus, the drain current of the driving TFT (Tr2) which drives the EL element E1 by electrical charges of the capacitor C1 is not dependent upon its threshold voltage, and as a result, the light emission intensity of the EL element E1 is not affected by variation of the threshold voltage of the driving TFT.

Accordingly, in the case where the pixel structure by the threshold voltage compensation technique shown in FIG. 2 is adopted, influence due to variations in threshold voltages of driving TFTs can be reduced effectively without particularly adding something such as a control line or the like to a light emitting display panel and without making a peripheral driving circuit complex.

With the structure shown in FIG. 2 in which the threshold voltage compensation technique is adopted, in the reset period in which the gate voltage accumulated in the capacitor C1 is reset, the terminal voltage of the capacitor C1, that is, the electrical potential of b point (Vb), is reset to the state of the fully low in the vicinity of the low level of Vdata via the controlling TFT (Tr1) and the portion between the gate and the source of TFT (Tr4) which functions as the reset element. Thus, with the structure shown in FIG. 2, the data voltage Vdata of the low level is applied similarly to the gate of the driving TFT (Tr2). Therefore, the driving TFT (Tr2) fully becomes the ON state (turn on state), though it is momentary, so as to allow a large amount of driving current (excess current) to flow in the EL element via the driving TFT (Tr2).

Under the influence of this, in the display panel, deterioration of contrast, deterioration of linearity in a low gradation, and the like occur, and problems, such as a problem that the life of a light emitting element is shortened, occur. In the example shown in FIG. 2, although the TFTs, all of which are of a P-channel type, are used, even when an N-channel type is employed for the respective TFTs, excess current momentarily flows in the EL element accompanied by the reset period similarly, and thus problems similar to the above problems occur.

SUMMARY OF THE INVENTION

The present invention has been developed as attention to the above-described technical problems has been paid, and it is an object to provide an active type light emitting display device which can solve the above-described problems by effectively restraining the flow of excess current which flows in a light emitting element via the driving TFT and which occurs in the reset operation in which electrical charges of the above-described capacitor are reset in a pixel structure in which the threshold voltage compensation technique is adopted.

A light emitting display device according to the present invention which has been developed to solve the above-described problems is, as described in claim 1, an active type light emitting display device in which a large number of pixel structures are arranged and in which the pixel structure is provided at least with a light emitting element, a driving TFT driving the light emitting element so that the light emitting element emits light, a controlling TFT controlling a gate voltage of the driving TFT, a threshold voltage generating element provided between the controlling TFT and a gate of the driving TFT and generating a gate voltage given to the driving TFT by level shifting a voltage corresponding to a threshold voltage of the driving TFT, a capacitor temporarily holding the gate voltage of the driving TFT, and a reset element resetting the gate voltage held in the capacitor to a predetermined voltage, and the present invention is characterized in that a current restraining means for restraining excess current from flowing into the light emitting element via the driving TFT is operated in a reset period in which the gate voltage held in the capacitor is reset to a predetermined electrical potential via the reset element.

DESCRIPTION OF THE PREFERRED EMBODIMENTS

Figure 1:
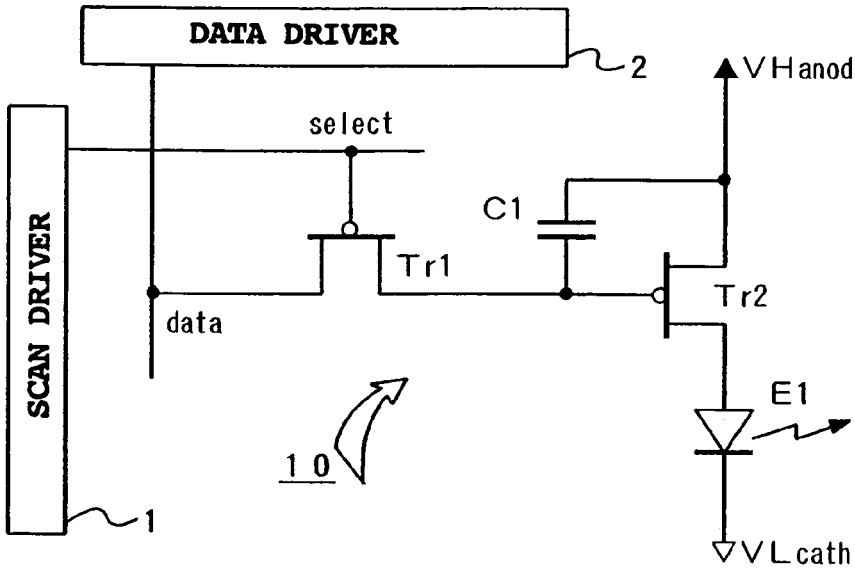
Fig.1 (Prior Art)
FIG. 1 is a connection diagram showing a circuit structure corresponding to one pixel in an active matrix type display device in which a conventional conductance control technique is adopted.
Figure 2:
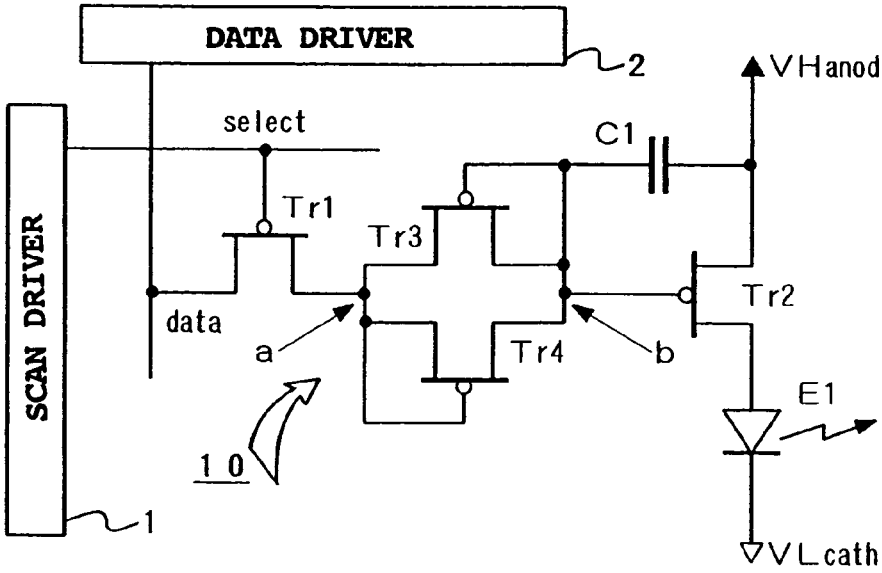
FIG. 2 is a connection diagram showing a circuit structure corresponding to one pixel in an active matrix type display device in which a threshold voltage compensation technique is adopted.
Figure 5:
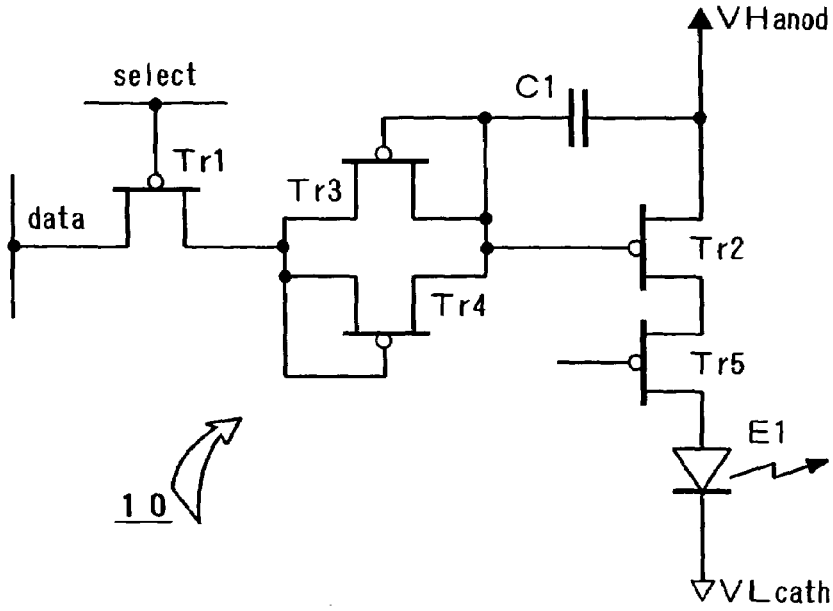
FIG. 5 is a connection diagram of a pixel unit showing a first embodiment in an active matrix type light emitting display device according to the present invention.

Light emitting display devices according to the present invention will be explained below based on embodiments shown in the drawings. In the following explanation, portions corresponding to the respective portions shown in FIG. 2 which have been already explained are denoted by like reference numerals, and therefore explanation for individual functions and operations will be omitted properly. First, FIG. 5 shows a first embodiment and shows a circuit structure corresponding to one pixel 10. All of each TFT (Tr1 to Tr5) in this first embodiment are comprised of P-channels, and the portion between the source and the gate of the TFT (Tr3) functions as the threshold voltage generating element as described above. The portion between the source and the gate of the TFT (Tr4) functions as the reset element.

In FIG. 5, a source and a drain of a TFT (Tr5) provided as a switching means are connected to the drain of the driving TFT (Tr2) and the anode of the EL element E1, respectively. That is, the switching TFT (Tr5) is laid in a series circuit composed of the driving TFT (Tr2) and the EL element E1. The TFT (Tr5) is brought to an OFF state in the period in which the gate voltage held in the capacitor C1 is reset and functions as a current restraining means by which excess current accompanied by the reset operation is restrained from flowing in the EL element E1.

Figure 3:
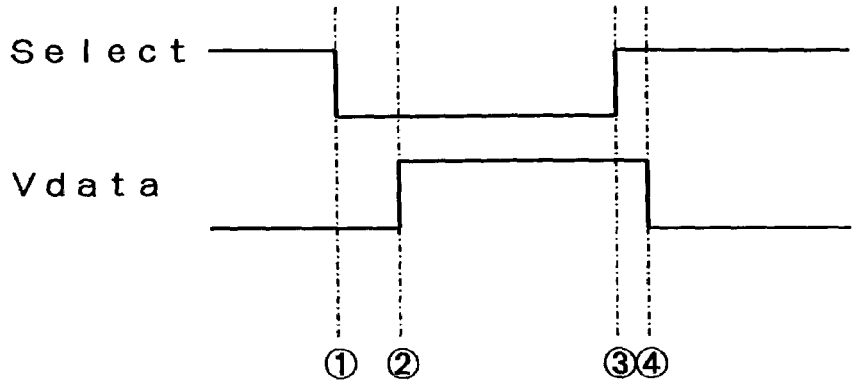
FIG. 3 is timing charts explaining operations in the display device shown in FIG. 2.
Figure 4:
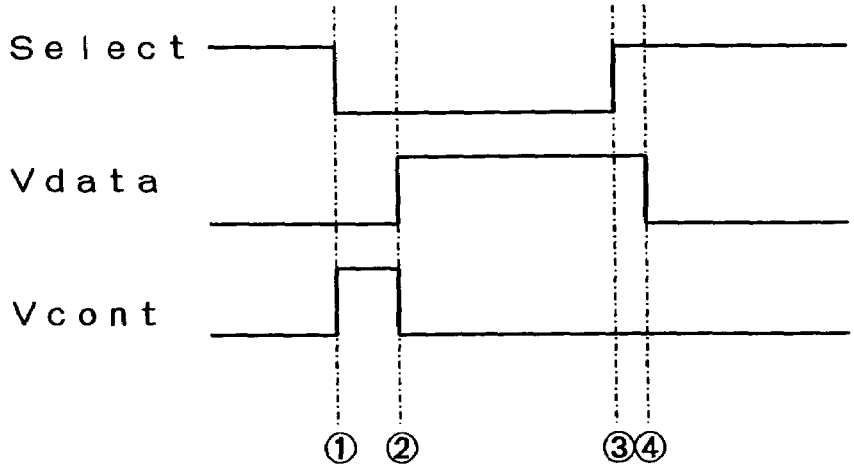
FIG. 4 is timing charts explaining operations in an active matrix type light emitting display device according to the present invention.

FIG. 4 is timing charts explaining such operations, and Select and Vdata shown in FIG. 4 are similar to the ON controlling voltage and the data voltage of the controlling TFT explained based on FIG. 3. In addition to these, in an active type light emitting display device in the present invention, a control voltage (Vcont) for operating the current restraining means is utilized. That is, the control voltage (Vcont) is generated in the reset period which is the period from 1 to 2.

In the embodiment shown in FIG. 5, the control voltage (Vcont) is supplied to a gate of the switching TFT (Tr5), and the TFT (Tr5) is controlled so as to be in an OFF state only in the reset period. Accordingly, even when the driving TFT (Tr2) is fully brought to the ON state in the reset period, since the switching TFT (Tr5) is in the OFF state, excess current can be restrained (inhibited) from flowing in the EL element E1.

Figure 6:
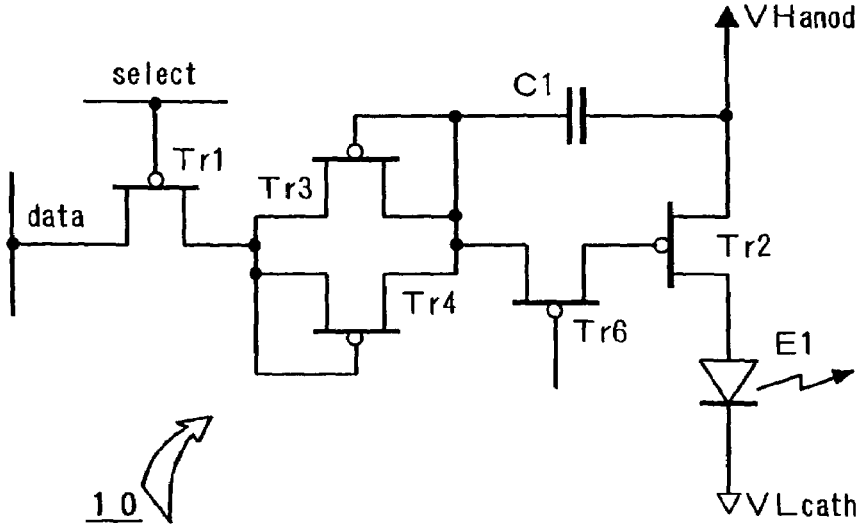
FIG. 6 is similarly a connection diagram of a pixel unit showing a second embodiment.

Next, FIG. 6 shows a second embodiment and shows a circuit structure corresponding to one pixel 10 similarly. All of each TFT (Tr1 to Tr4 and Tr6) in this second embodiment are comprised of P-channels. A source and a drain of a TFT (Tr6) functioning as a switching means are connected to the gate voltage holding terminal of the capacitor C1, that is, the gate of the TFT (Tr3) functioning as a threshold voltage generating element, and the gate of the driving TFT (Tr2), respectively. In this structure, the TFT (Tr6) is brought to an OFF state in the period in which the gate voltage held in the capacitor C1 is reset.

In this case also, the control voltage (Vcont) generated in the reset period from 1 to 2 as shown in FIG. 4 is utilized, and the switching TFT (Tr6) is controlled so as to be brought to the OFF state only in the reset period. Accordingly, in the reset period the connection between the capacitor C1 and the gate of the driving TFT (Tr2) is cut off, and a gate bias voltage which is generated accompanied by the reset operation and which is used for operating the driving TFT (Tr2) so that the TFT (Tr2) performs the ON operation is inhibited from being applied to. That is, the TFT (Tr6) in this embodiment functions as a current restraining means for restraining (inhibiting) excess current from flowing in the EL element E1 in the reset period.

Figure 7:
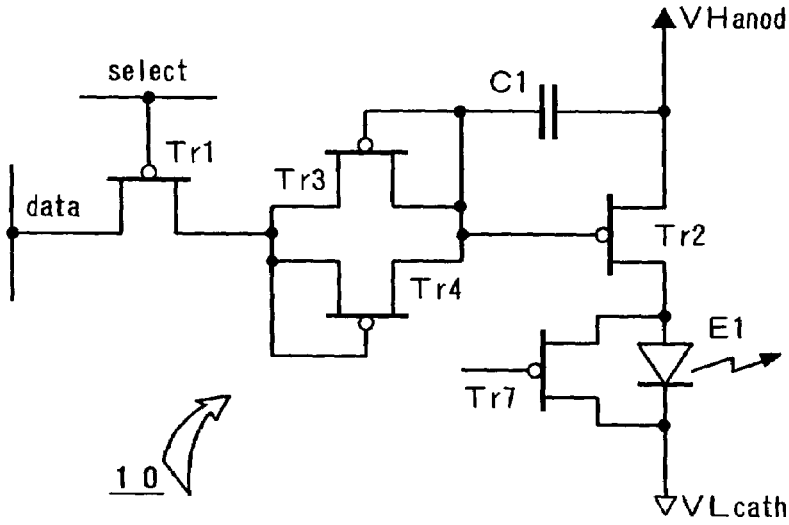
FIG. 7 is similarly a connection diagram of a pixel unit showing a third embodiment.

FIG. 7 shows a third embodiment and shows a circuit structure corresponding to one pixel 10 similarly. All of each TFT (Tr1 to Tr4 and Tr7) in this third embodiment are comprised of P-channels. In this embodiment, a switching TFT (Tr7) is connected in parallel to both end portions of the EL element E1. That is, a source of the TFT (Tr7) is connected to the anode of the EL element E1, and a drain of the TFT (Tr7) is connected to the cathode of the EL element E1.

In the structure shown in this FIG. 7 also, the control voltage (Vcont) generated in the reset period from 1 to 2 as shown in FIG. 4 is utilized, and the switching TFT (Tr7) is controlled so as to be in an ON state only in the reset period. That is, both terminals of the EL element E1 is short circuited by the switching TFT (Tr7) in the reset period. Accordingly, even though the driving TFT (Tr2) is brought fully to the ON state in the reset period, most of the drain current flowing in the driving TFT (Tr2) bypasses the switching TFT (Tr7) which has been brought to the ON state. That is, the TFT (Tr7) functions as a current restraining means for restraining excess current from flowing in the EL element E1 in the reset period.

Figure 8:
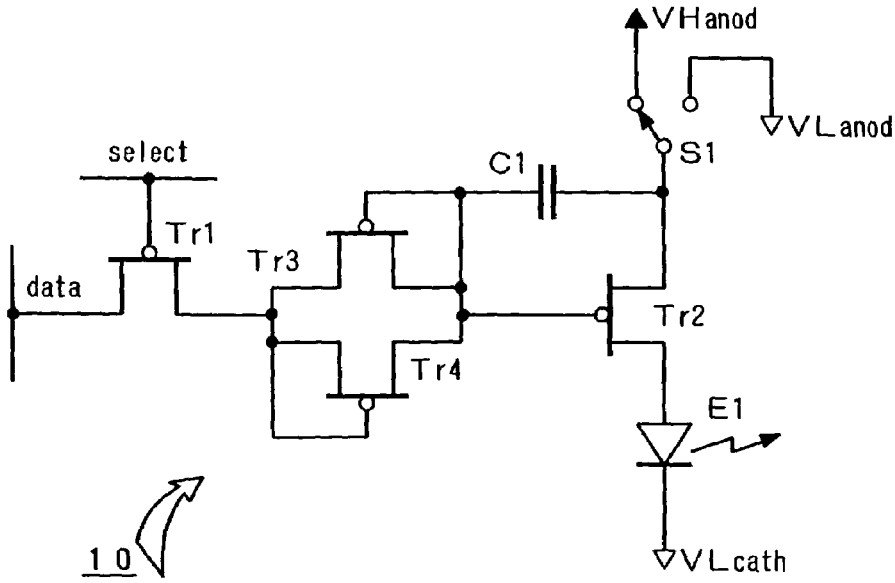
FIG. 8 is similarly a connection diagram of a pixel unit showing a fourth embodiment.

FIG. 8 shows a fourth embodiment and shows a circuit structure corresponding to one pixel 10 similarly. All of each TFT (Tr1 to Tr4) in this fourth embodiment are comprised of P-channels. In this embodiment, prepared are an anode side power source (VHanod) utilized at a light emission driving time of the EL element E1 and an anode side power source (VLanod) utilized at the reset operation time, and these power sources are constructed so as to be selected alternatively by a switch S1. The electrical potential levels of the anode side power sources VHanod and VLanod have a relationship of VHanod>VLanod.

In the structure shown in this FIG. 8 also, the control voltage (Vcont) generated in the reset period from 1 to 2 as shown in FIG. 4 is utilized, and the switch S1 operates so as to select the low voltage anode side power source (VLanod) only in the reset period. That is, the switch S1 constitutes a voltage switching means for decreasing a driving voltage which is applied to the anode side of the EL element E1 in the reset period.

With the structure shown in FIG. 8, even when the driving TFT (Tr2) is brought fully to the ON state in the reset period, since the electrical potential difference between the anode side power source (VHanod) and a cathode side power source (VLcath) is made small, excess current is restrained from flowing in the EL element E1. That is, the voltage switching means including the switch S1 functions as a current restraining means for restraining excess current from flowing in the EL element E1 in the reset period.

In the structure shown in FIG. 8, although the low voltage anode side power source (VLanod) is selected by the switch S1 in the reset period, a structure in which the low voltage anode side power source (VLanod) is removed to be changed to an open terminal can be adopted. In the case where such structure is adopted, in the reset period, the driving voltage (VHanod) applied to the anode side of the EL element can be cut off from this anode side so that the EL element can be in an open state, so that excess current can be restrained (inhibited) from flowing in the EL element E1.

Figure 9:
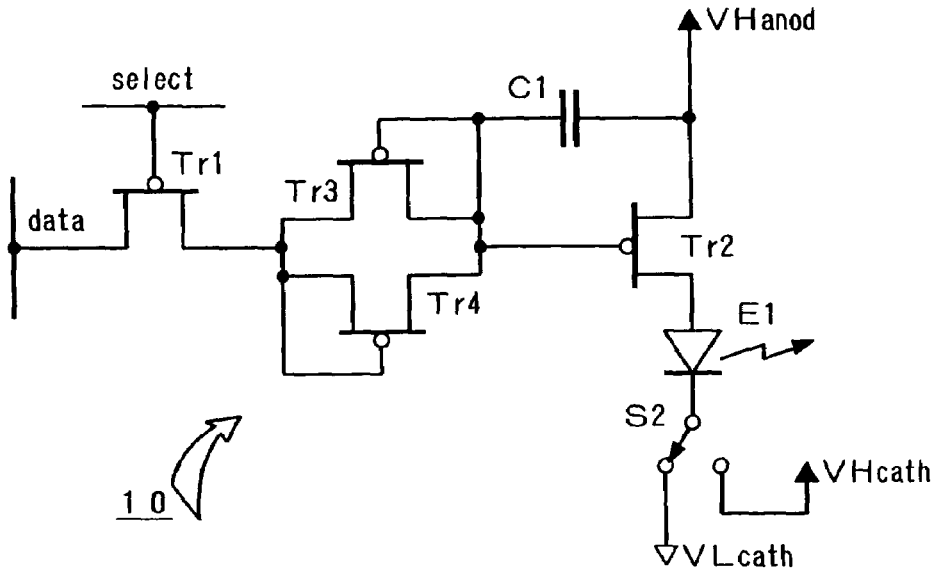
FIG. 9 is similarly a connection diagram of a pixel unit showing a fifth embodiment.

FIG. 9 shows a fifth embodiment and shows a circuit structure corresponding to one pixel 10 similarly. All of each TFT (Tr1 to Tr4) in this fifth embodiment are also comprised of P-channels. In this embodiment, prepared are a cathode side power source (VLcath) utilized in the light emission driving time of the EL element E1 and a cathode side power source (VHcath) utilized at the reset operation time, and these power sources are constructed so as to be selected alternatively by a switch S2. The electrical potential levels of the cathode side power sources VLcath and VHcath have a relationship of VLcath<VHcath.

In the structure shown in this FIG. 9 also, the control voltage (Vcont) generated in the reset period from 1 to 2 as shown in FIG. 4 is utilized, and the switch S2 operates so as to select the high voltage cathode side power source (VHcath) only in the reset period. That is, the switch S2 constructs a voltage switching means for increasing a driving voltage which is applied to the cathode side of the EL element in the reset period.

With the structure shown in this FIG. 9, even when the driving TFT (Tr2) is brought fully to the ON state in the reset period, since the electrical potential difference between an anode side power source (VHanod) and the cathode side power source (VHcath) is made small, excess current is restrained from flowing in the EL element E1. That is, the voltage switching means including the switch S2 functions as a current restraining means for restraining excess current from flowing in the EL element E1 in the reset period.

In the structure shown in FIG. 9, although the high voltage cathode side power source (VHcath) is selected by the switch S2 in the reset period, a structure in which the high voltage cathode side power source (VHcath) is removed to be changed to an open terminal can be adopted. In the case where such structure is adopted, in the reset period, the driving voltage (VLcath) applied to the cathode side of the EL element can be cut off from this cathode side so that the EL element can be in the open state, so that excess current can be restrained (inhibited) from flowing in the EL element E1.

Figure 10:
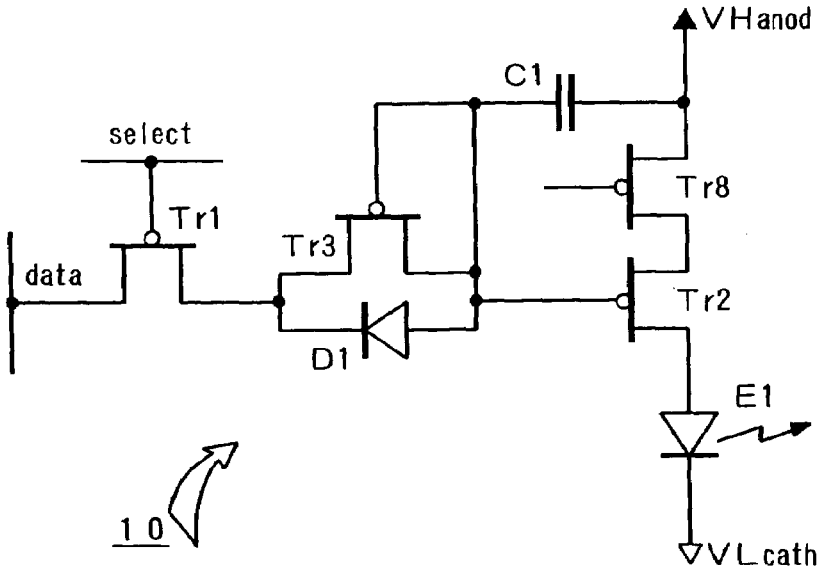
FIG. 10 is similarly a connection diagram of a pixel unit showing a sixth embodiment.

FIG. 10 shows a sixth embodiment and shows a circuit structure corresponding to one pixel 10 similarly. All of each TFT (Tr1 to Tr3 and Tr8) in this sixth embodiment are also comprised of P-channels. In this embodiment, a diode D1 is employed as a reset element. That is, an anode of the diode D1 is connected to the gate of the TFT (Tr3) functioning as the threshold voltage generating element, and a cathode of the diode D1 is connected to the source of the TFT (Tr3).

The diode D1 in this structure performs an ON operation at an electrical potential difference by a threshold voltage or greater that this diode D1 has, and performed is an operation in which the gate voltage of the driving TFT (Tr2) accumulated in the capacitor C1 is reset via this diode D1. This reset operation is similar to the operation explained based on FIG. 2.

In the embodiment shown in this FIG. 10, a source and a drain of the TFT (Tr8) are connected to an anode side power source (VHanod) and the source of the driving TFT (Tr2), respectively. That is, the TFT (Tr8) is constructed so as to be laid in a series circuit composed of the driving TFT (Tr2) and the EL element E1. The TFT (Tr8) is brought to an OFF state in the period in which the gate voltage held in the capacitor C1 is reset and functions as a current restraining means by which excess current accompanied by the reset operation is restrained from flowing in the EL element E1.

In the structure shown in this FIG. 10, the control voltage (Vcont) generated in the reset period from 1 to 2 as shown in FIG. 4 is utilized, and the TFT (Tr8) is controlled so as to be in the OFF state only in the reset period. Therefore, even when the driving TFT (Tr2) is brought fully to the ON state in the reset period, since the TFT (Tr8) is in the OFF state, excess current can be restrained (inhibited) from flowing in the EL element E1.

In the already explained structures shown in FIGS. 5 to 9 also, the reset element by the diode D1 shown in FIG. 10 can be employed instead of the TFT (Tr4) functioning as a reset element.

Figure 11:
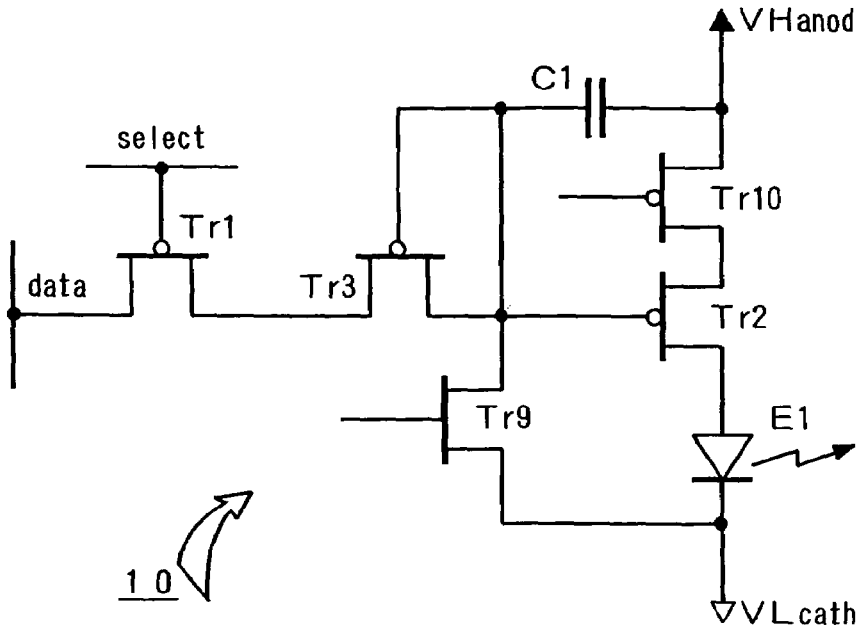
FIG. 11 is similarly a connection diagram of a pixel unit showing a seventh embodiment.

FIG. 11 shows a seventh embodiment and shows a circuit structure corresponding to one pixel 10 similarly. In this seventh embodiment, all TFTs except a TFT functioning as a reset element described later are comprised of P-channels. In this embodiment, in an N-channel type TFT (Tr9) functioning as a reset element, a drain thereof is connected to the gate of the driving TFT (Tr2), and a source thereof is connected to a cathode side power source (VLcath).

In the embodiment shown in this FIG. 11 also, a TFT (Tr10) functioning as a current restraining means is connected between an anode side power source (VHanod) and the source of the driving TFT (Tr2). That is, the arrangement of the TFT (Tr10) is similar to that of the TFT (Tr8) shown in FIG. 10.

In the structure shown in this FIG. 11 also, the control voltage (Vcont) generated in the reset period from 1 to 2 as shown in FIG. 4 is utilized so as to control the TFT (Tr9) and the TFT (Tr10) so that the TFTs (Tr9 and Tr10) become an ON state and an OFF state, respectively, in the reset period. As mentioned, the TFT (Tr9) is controlled so as to be in the ON state in the reset period so that the terminal voltage of the capacitor C1 is lowered to the electrical potential of the cathode side power source (VLcath) and is reset. At this time since the TFT (Tr10) is controlled so as to be in the OFF state, even when the driving TFT (Tr2) is brought fully to the ON state by the reset operation, excess current can be restrained (inhibited) from flowing in the EL element E1.

In the case where the TFT (Tr9) functioning as a reset element is an N-channel type and the TFT (Tr10) functioning as a current restraining means is a P-channel type as in the embodiment shown in FIG. 11, one control voltage (Vcont) can be used commonly for the ON and OFF control of the respective TFTs (Tr9 and Tr10).

In the embodiment shown in FIG. 11, although the source of the TFT (Tr9) functioning as a reset element is connected to the cathode side power source (VLcath), the source of the TFT (Tr9) may be connected to another voltage source. In short, with the structure shown in FIG. 11, by the reset operation by the TFT (Tr9), the terminal voltage of the capacitor C1 is once reset to the source side electrical potential of this TFT (Tr9). Then, By the write operation for data which follows this resetting, the terminal voltage of the capacitor C1 is determined.

In the already explained structures shown in FIGS. 5 to 9 also, the connection structure of the TFT (Tr9) shown in FIG. 11 can be adopted instead of the TFT (Tr4) functioning as a reset element. Further, in the already explained structure shown in FIG. 10 also, the connection structure of the TFT (Tr9) shown in FIG. 11 can be adopted instead of the diode D1 functioning as a reset element.

In the respective embodiments shown in FIGS. 5 to 11 explained above, since excess current can be effectively restrained from flowing in the EL element E1 via the driving TFT (Tr2) in the reset period, technical problems such as deterioration of contrast and deterioration of linearity in a low gradation on a display panel, a shortened life of a light emitting element, and the like can be solved.

In most of the respective embodiments explained above, P-channel type TFTs are employed. Constructing a pixel by P-channel type polysilicon TFT scan contribute to simplification of manufacturing processes and to reliability improvement of a light emitting display panel. However, an active type light emitting display device according to the present invention is not limited to this, and it is desirable that at least the driving TFT (Tr2) and the respective TFTs (Tr3) shown in FIGS. 5 to 11 which function as threshold voltage generating elements are both constituted by the same channel type.

By constituting the driving TFT (Tr2) and the TFT (Tr3) functioning as a threshold voltage generating element by the same channel type, the driving TFT (Tr2) and the TFT (Tr3) functioning as the threshold voltage generating element can be permitted to have approximately the same threshold characteristics. By this described effect, the threshold characteristic that the driving TFT has can be effectively cancelled.

With an active type light emitting display device according to the present invention explained above, by eliminating the influence of variations in threshold voltages of driving TFTs, it is possible to make the most of a characteristic that unevenness in light emission intensities can be corrected. Furthermore, the above-described special effect of the present invention that deterioration of linearity in a low gradation can be prevented and the like can also be expected. Therefore, an active type light emitting display device according to the present invention can be suitably adopted into an analog type gradation driving technique in which gradation is represented by the data voltage (Vdata) sent from the data driver 2 shown in FIG. 2.

An active type light emitting display device according to the present invention can be suitably adopted into a display device provided with a time gradation means which realizes a digital gradation representation by controlling a light emission driving time given to each EL element. Furthermore, an active type light emitting display device according to the present invention can be suitably adopted into a display device provided with an area gradation means which divides one pixel into a plurality of sub-pixels to control the number of lightings of the divided sub-pixels.

What is claimed is:

1. An active type light emitting display device in which a large number of pixel structures are arranged, said pixel structure at least comprising a light emitting element; a driving TFT driving the light emitting element so that the light emitting element emits light; a controlling TFT controlling a gate voltage of the driving TFT; a threshold voltage generating element provided between the controlling TFT and a gate of the driving TFT and generating a gate voltage given to the driving TFT by level shifting a voltage corresponding to a threshold voltage of the driving TFT; a capacitor temporarily holding the gate voltage of the driving TFT; and a reset element resetting the gate voltage held in the capacitor to a predetermined voltage, wherein a current restraining means for restraining excess current from flowing into the light emitting element via the driving TFT is operated in a reset period in which the gate voltage held in the capacitor is reset to a predetermined electrical potential via the reset element.

2. The active type light emitting display device according to claim 1, wherein the threshold voltage generating element is constructed between at least one gate and one source within at least one TFT formed in one pixel structure.

3. The active type light emitting display device according to claim 1 or 2, wherein the reset element is constructed between at least one gate and one source within at least one TFT formed in one pixel structure.

4. The active type light emitting display device according to claim 3, wherein the reset element constructed between the source and the gate of the TFT is connected to the source and the gate of the TFT functioning as the threshold voltage generating element in a mutual reverse parallel state so that the gate voltage held in the capacitor is reset to a predetermined voltage by an ON operation between the source and the gate in the reset element.

5. The active type light emitting display device according to claim 1 or 2, wherein the reset element is constructed between an anode and a cathode in a diode formed in the same pixel structure including the driving TFT and the light emitting element.

6. The active type light emitting display device according to claim 5, wherein in the reset element constructed between the anode and the cathode in the diode, said cathode and said anode are connected to the source and the gate of the TFT functioning as the threshold voltage generating element, respectively, in a parallel state, and the gate voltage held in the capacitor is reset to a predetermined voltage by an ON operation between the anode and the cathode in the diode.

7. The active type light emitting display device according to claim 1 or 2, wherein the reset element is connected between a source and a drain within at least one TFT formed in one pixel structure, and the gate voltage held in the capacitor is reset to a predetermined voltage by an ON operation between said source and said drain.

8. The active type light emitting display device according to claim 1, wherein the current restraining means is laid in a series circuit composed of the driving TFT and the light emitting element and is constituted by a switching means which performs an OFF operation in the reset period.

9. The active type light emitting display device according to claim 1, wherein the current restraining means is provided between a gate voltage holding terminal of the capacitor and the gate of the driving TFT and is constituted by a switching means which performs an OFF operation in the reset period.

10. The active type light emitting display device according to claim 1, wherein the current restraining means is constituted by a switching means which is connected in parallel to both end portions of the light emitting element and which performs an ON operation in the reset period.

11. The active type light emitting display device according to claim 1, wherein the current restraining means is constituted by a voltage switching means which decreases a driving voltage applied to an anode side of the light emitting element in the reset period.

12. The active type light emitting display device according to claim 1, wherein the current restraining means is constituted by a voltage switching means which increases a driving voltage applied to a cathode side of the light emitting element in the reset period.

13. The active type light emitting display device according to claim 1, wherein the current restraining means is constituted in such a way that a driving voltage applied to an anode side of the light emitting element is cut off from said anode side in the reset period.

14. The active type light emitting display device according to claim 1, wherein the current restraining means is constituted in such a way that a driving voltage applied to a cathode side of the light emitting element is cut off from said cathode side in the reset period.

15. The active type light emitting display device according to claim 2, wherein at least the driving TFT and a TFT forming the threshold voltage generating element are constituted by the same channel TFTs.

16. The active type light emitting display device according to claim 1, wherein the light emitting element is constituted by an organic EL element in which an organic compound is employed in a light emitting layer.

* * * * *